US007712919B2

(12) United States Patent
Koivisto

(10) Patent No.: US 7,712,919 B2
(45) Date of Patent: May 11, 2010

(54) OPERATION LIGHT

(75) Inventor: Juda Koivisto, Helsinki (FI)

(73) Assignee: Planmeca Oy, Helsinki (FI)

( * ) Notice: Subject to any disclaimer, the term of this patent is extended or adjusted under 35 U.S.C. 154(b) by 92 days.

(21) Appl. No.: 11/911,263

(22) PCT Filed: Apr. 12, 2006

(86) PCT No.: PCT/FI2006/050153

§ 371 (c)(1),
(2), (4) Date: Oct. 11, 2007

(87) PCT Pub. No.: WO2006/108929

PCT Pub. Date: Oct. 19, 2006

(65) Prior Publication Data

US 2008/0192468 A1 Aug. 14, 2008

(30) Foreign Application Priority Data

Apr. 12, 2005 (FI) ..... 20050373
Apr. 12, 2005 (FI) ..... 20050376

(51) Int. Cl.
*F21V 7/00* (2006.01)

(52) U.S. Cl. ..... 362/247; 362/217.02; 362/217.05; 362/296.01

(58) Field of Classification Search ..... 362/217.02, 362/217.05, 247, 296.01
See application file for complete search history.

(56) References Cited

U.S. PATENT DOCUMENTS 3,894,228 A 7/1975 Cobb, Jr.
4,234,247 A 11/1980 Dorman
2001/0030867 A1 10/2001 Gampe et al.
2002/0006039 A1 1/2002 Ueda
2002/0030993 A1 3/2002 Itoh

FOREIGN PATENT DOCUMENTS

JP 2005-149996 9/2005
JP 2006-059625 3/2006
WO 02/06723 A1 1/2002

*Primary Examiner*—Sandra L O'Shea
*Assistant Examiner*—Meghan K Dunwiddie
(74) *Attorney, Agent, or Firm*—Cozen O'Connor

(57) ABSTRACT

The invention relates to an operation light, comprising at least one light-emitting component (9) and at least one light-reflecting surface Mn and in which the light-emitting surface of the light-emitting component (9) is so arranged in the operation light that all or substantially all of the light produced by the operation light consists of light reflected from the reflecting surface, and for each light-emitting component (9) at least one substantially planar light-reflecting surface Mn is provided so that the dimensions of the light-emitting surface of each light-emitting component (9), the direction of the normal to the surface and the distance of the surface in relation to the size of the reflecting surface Mn arranged for the light-emitting component (9) in question, to the direction of the normal to the surface and to the distance of the surface from the surface (11) to be illuminated have been so arranged that the operation light produces on the surface to be illuminated a light pattern of a given shape and size wherein the light intensity in the penumbral shadow area formed at the edges of the light pattern falls in a desired manner.

20 Claims, 2 Drawing Sheets

OPERATION LIGHT

Figure 1:
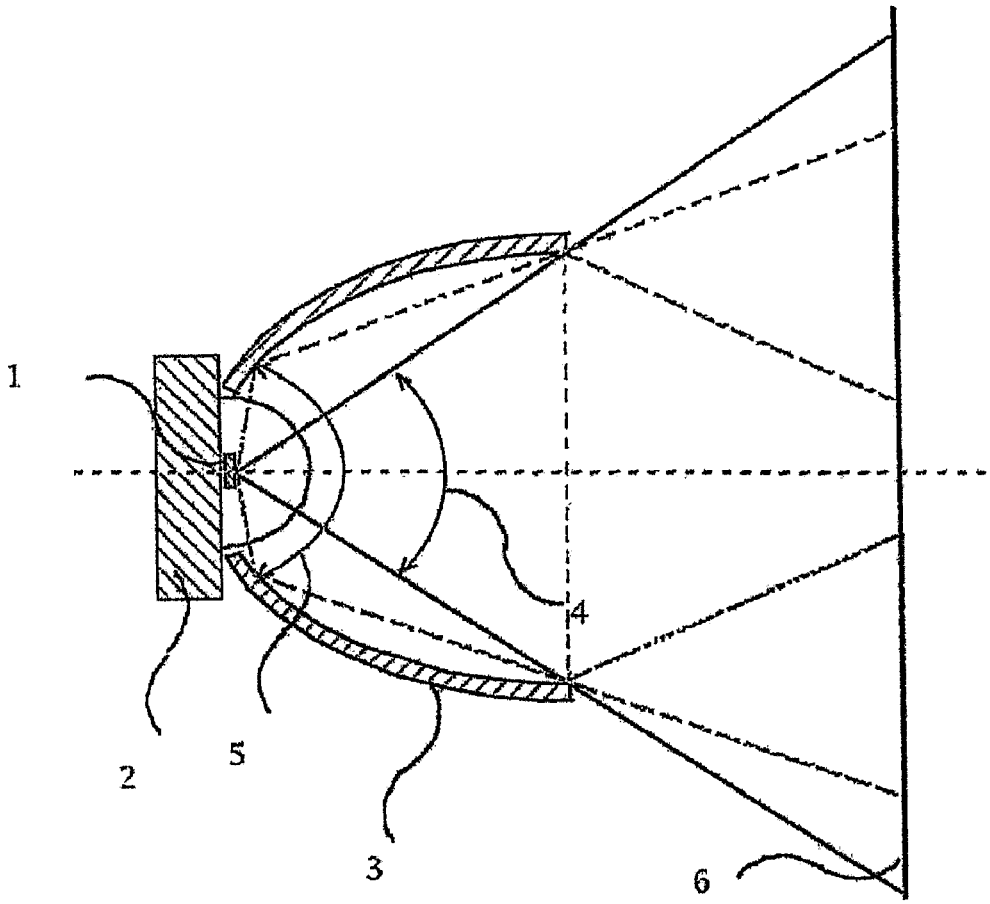

The present invention relates to an operation light as defined in the preamble of claim 1, in particular to a LED light for use in connection with dental operations.

Prior-art LED light sources are generally implemented using a solution in which an ordinary incandescent lamp is simply replaced by a light emitting diode, in other words LED. While emitting light from the surface of a semiconductor a LED produces an intensity distribution wherein the intensity is proportional to the angle formed between the normal to this surface and the observer. The LED emits light most in the direction of the normal to the surface, and the intensity of the light decreases the more, the more the angle of observation of the LED deviates from the normal to the surface. As seen from the side, the emitting surface practically emits no light at all.

There are many lights which are required to produce a controlled light pattern and to allow the possibility for elimination of glare. As regards dental operation lights, standard ISO 9680 defines criteria relating to these properties, among other things. The standard requires, among other things, that the light pattern produced by the light should comprise an area where the intensity of light is sufficiently high but at the same time uniform. On the other hand, it is required that to ensure that the patient will not be dazzled, the edge of the light pattern produced by the light should be sufficiently sharp, i.e. such that the intensity decreases sufficiently rapidly at the edge of the light pattern.

In LED lights, a prior-art practice is to arrange a reflector at an angle relative to the normal to the light-emitting surface for collecting and directing the light being emitted. A construction like this may be implemented e.g. in such manner that the emitting surface of the LED is directed towards the object to be illuminated while the reflector is arranged to collect and focus light emitted at a substantially large angle relative to the normal to the LED's surface towards the object to be illuminated. As e.g. in the case of a dental operation light, the distance between the surface to be illuminated and the LED in such solutions is significantly larger than the reflector dimension in the direction of the optical axis, a reflector like this can collect and focus to the surface to be illuminated only such portion of the light emitted at angle from the surface of the LED whose intensity is relatively low. Thus, only that portion of the light can be utilized which is emitted substantially perpendicularly from the LED, plus a relatively low-intensity portion emitted from the LED surface at a large angle, whereas light emitted at a small angle but having a relatively high intensity remains unutilized. On the other hand, in the case of an operation light, this very portion of the emitted light that the reflector cannot collect is apt to reduce the sharpness of the edge of the light pattern produced, i.e. in practice to cause glare.

In prior-art solutions, a known practice is also to use a lens in front of the LED light source to improve the light collecting capacity, i.e. to collect light emitted at an angle from the LED surface. The lens has been used as a means of collecting substantially that portion of the solid angle that cannot be collected by a reflector. The lens may be separate or integrated directly with the LED. The lens has to be placed within the reflector and substantially close to the light-emitting surface, and for the lens not to obstruct the light reflected from the reflector surface to the object to be illuminated, it has to be sufficiently small in dimensions, e.g. substantially the same size with the light-emitting surface. The light pattern produced by such a light source has a relatively low intensity and gently gradated edges.

It is also possible to arrange the normal to the light-emitting surface to point away from the surface to be illuminated, by placing a reflector in the direction of the light-emitting surface. A reflector solution of this type is presented in FIG. 4 of patent publication WO 02/06723. The light reflected from the concave surface described in the specification has the same kind of intensity distribution as the light emitted from the LED, and consequently no sharp contrast is produced at the edges of the reflected light pattern, either, in other words, also in this case the edge of the light pattern is left gently gradated.

The object of the present invention is to create a new type of LED operation light comprising a reflector wherein the light emitted from a light source can be collected at a high efficiency, preferably so that a light pattern substantially of a given shape and size is formed on the surface to be illuminated. It is also an object to achieve a structure that allows achieving a good light intensity on the surface to be illuminated by a relatively small number of LEDs and/or by relatively low-power LEDs.

Essential features of the invention and its preferred embodiments are presented in the claims below. Thus, the structure of the invention comprises, preferably a large number of, reflecting surfaces preferably of a substantially planar shape, which are arranged in the light in a certain manner, to be described in greater detail below. The light of the invention can produce a light pattern of substantially uniform intensity. The invention provides a basic light structure wherein, simply by varying the dimensions and mutual positioning of the components, light patterns having a given shape and/or comprising a given kind of penumbral shadow can be easily produced on surfaces to be illuminated at different distances from the light source. Using the structure of the invention, it is possible to implement a light pattern wherein the edge of the light pattern can be arranged to have a desired contrast. The basic structure of the light makes it possible to produce different light patterns without a necessity to collimate the light beam.

Figure 2:
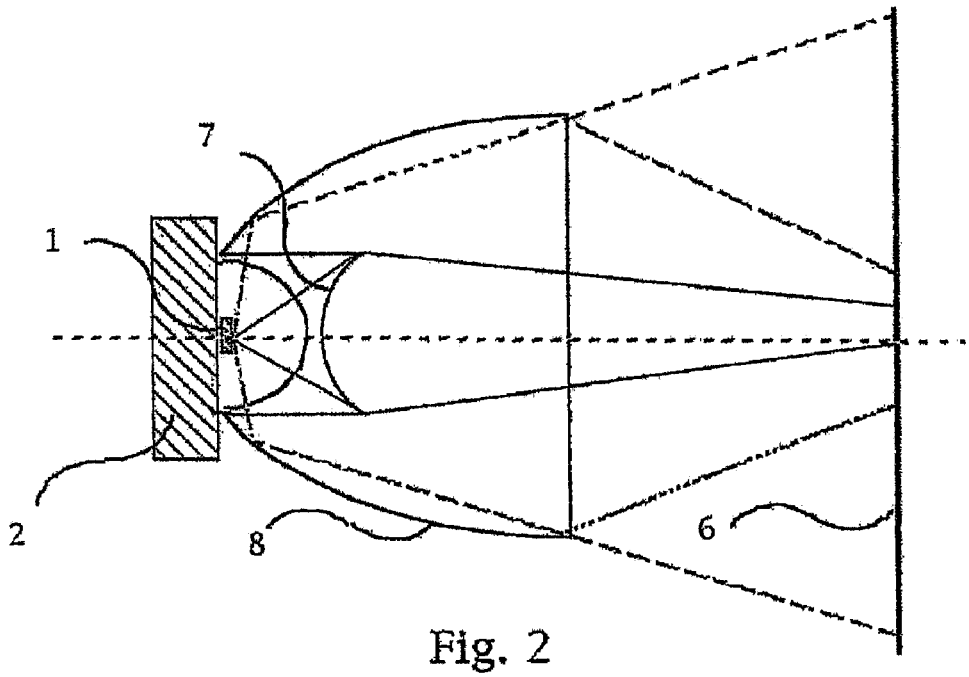
Figure 3A:
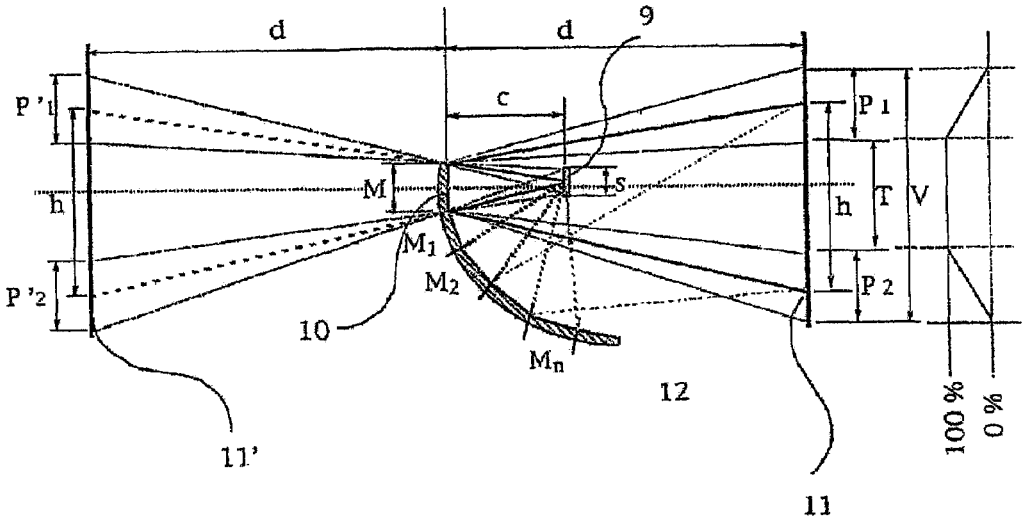
Figure 3B:
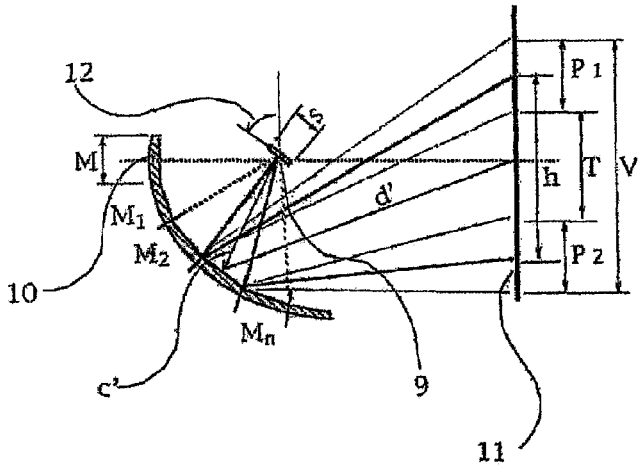

In the following, the invention and its preferred embodiments will be described in greater detail with reference to the attached figures, of which FIG. 1 presents a prior-art light source, FIG. 2 presents a prior-art light source provided with a lens, FIG. 3A illustrates the principle of the light of the invention, FIG. 3B presents a preferred embodiment of the light of the invention.

In the prior-art structure presented in FIG. 1, a light-emitting component (1) is attached to a frame part (2), to which is also connected a reflector (3) to collect light emitted from the light-emitting component (1) at a large angle from the normal to the light-emitting surface and to direct it towards the surface (6) to be illuminated. However, the reflector is incapable of collecting that portion of the light that is emitted at an angle equal to or smaller than angle (4).

The prior-art solution illustrated in FIG. 2 uses a solid reflecting element (8) arranged in the structure to improve the light collecting capacity. In addition, the solution comprises a lens (7) arranged within the reflecting element to collect that portion of the light, which cannot be collected by the reflector. For the lens (7) not to obstruct the light coming from the reflector (8), its size and distance from the surface of the light-emitting component (1) have to be arranged to be relatively small. In practice, the distance of the light-emitting component from the lens is generally very small as compared to the distance of the light source from the object to be illuminated. Therefore, it is not possible to produce a sharp-edged light pattern of substantially uniform intensity with such a light source, and consequently, if used e.g. as a dental operation light, it would dazzle the patient.

FIG. 3A illustrates the principle according to which a certain type of light pattern and a certain type of penumbral shadow can be produced by the light of the invention on the surface to be illuminated. The figure presents a preferred embodiment of the invention as a two-dimensional projection of a light source, a reflecting surface and a surface to be illuminated, comprising a light-emitting component (9) and a plurality of reflecting surfaces M1, M2, . . . Mn, which form a reflector (10). Generally speaking, the light may comprise several light-emitting components (9), with at least one light-reflecting surface Mn provided for each light-emitting component (9). However, the light preferably has at least two, preferably a plurality of light-reflecting surfaces Mn for each at least one, light-emitting component (9), and thus an over-shadowing obstruction, such as the dentist's hand, that may get between the operation light and the object to be illuminated will not darken the area to be illuminated. The operation light preferably has a large number of light-reflecting surfaces of relatively small dimensions, such as of the order of below 10 mm, such as about 2-6 mm, when the distance between the light-emitting surface and the light-reflecting surface is of the order of below 35 mm. The light-emitting surface of the light-emitting component (9) has been arranged in the illuminator in such a way that all or substantially all of the light produced by the illuminator consists of light reflected from the reflecting surfaces.

FIG. 3A also shows the surface (11) on which the light pattern produced by the light source is reflected. The figure illustrates the way in which light is reflected from a light-reflecting surface so arranged in relation to the light-emitting surface that the normal to its surface is parallel to the normal to the light-reflecting surface. The dimension of the light-emitting component (9) is s and the distance between the light-emitting surface and the light-reflecting surface Mn is c (The figure only shows the dimension c of a reflecting surface located in the direction of the optical axis of the light source. Optical axis of the light source here refers to the axis passing via the centers of the light-emitting surface and the light pattern produced by the light source.) The dimension of the light-reflecting surface Mn is M.

The reflecting surface Mn can be thought of as being a window through which the light passes to a virtual surface (11') located at distance d from the window. The light rays coming from the level of the center of the finite light-emitting component (9) and passing via surface Mn form a pattern whose dimension is h on surface (11'). On the other hand, the light rays coming from the level of the lower edge of the light-emitting component (9) and passing via surface Mn form a penumbral shadow whose dimension is P1' on surface (11'). Similarly, the light rays coming from the level of the upper edge of the light-emitting component (9) form a penumbral shadow whose dimension is P2' on surface (11'). On surface (11') is formed a light pattern whose dimension h has a length corresponding to the length of the dimension M of the light-emitting surface in the ratio of distances c and d. The dimensions P1', P2' of the penumbral shadows again depend on dimensions M and the ratio of distances c and d.

As surface (10) is of light-reflecting material, the light-emitting component (9) produces a corresponding light pattern dimension h and penumbral shadows P1 and P2 on surface (11), which is located at a distance d from the light-reflecting surface Mn. Thus, when the dimensions M of the light-reflecting surfaces on the one hand and their distances d from the surface (11) on which the light is to produce a desired light pattern on the other hand are arranged in a suitable manner, each light-reflecting surface Mn can be arranged to form an identical light pattern in the same place on the surface (11).

The height h of the light pattern can be calculated as follows:

$$h = \frac{M * (d + c)}{c}$$

The height of the penumbral shadow can be calculated as follows:

$$P = \frac{s * d}{c}$$

The height T of a light pattern of substantially uniform intensity is:

$$T = h - \frac{P_1 + P_2}{2}$$

FIG. 3A additionally presents a simplified illustration of how the light of the invention can produce an intensity distribution of the light pattern V wherein the intensity is reduced quite rapidly in the area of the penumbral shadow. Especially in a dental operation light, it is essential that the area of the penumbral shadow is short to prevent dazzling of the patient.

According to a preferred embodiment of the invention, the light-emitting surface is arranged in relation to the light-reflecting surface in such manner that the ratio of the distance between said surfaces to a dimension of the light-emitting surface is in the range of 5-300 in the plane of the dimension in question. On the other hand, for each light-emitting component (9), preferably at least two light-reflecting surfaces Mn are arranged in such manner that, considering a light pattern forming surface (11) at a distance in the range of 0.2-5 m, such as in the range of the order of below 1 m from the operation light (9), the sum of the distances of the aforesaid at least two light-reflecting surfaces Mn to the light-emitting surface on the one hand (c) and to the aforesaid light pattern forming surface (11) on the other hand is substantially the same.

To simplify the presentation of the matter, the structure has been described above in two dimensions and only concerning a light-reflecting surface placed perpendicularly to the emitting surface. As for the other surfaces, the angle between the normal to the reflecting surface and the normal to the emitting surface has to be taken into account in a manner obvious to a person skilled in the art.

In the structure according to FIG. 3A, the light-emitting component (9) is so placed that it obstructs the light pattern (11) reflected via an emitting surface positioned perpendicularly to itself. FIG. 3B therefore presents a preferred embodiment of the invention wherein the center of the light-emitting surface is still placed on the optical axis of the light source but it has been turned to an angle (12) relative to the optical axis. In both structures illustrated in these two figures, the light-reflecting surfaces, precisely speaking their centers, can be thought of as forming a structure substantially having the shape of an elliptic arc, and the light-reflecting component as being arranged substantially at that focus of the ellipse in question which is closer to that part of the elliptic arc where the aforesaid light-reflecting surfaces are located. The reflecting surfaces can also be placed on an arc defined by some other mathematical function, by turning the angles of the reflecting surfaces relative to the emitting surface respectively so that the reflecting surfaces are placed at a corresponding angle such that the light fields produced by them will fall one over the other in a corresponding manner. For each light-reflecting surface Mn, the sum of dimensions d and s is substantially the same. As compared to the structure illustrated in FIG. 3A, in the embodiment of FIG. 3B advantageously the very portion of the light produced by the light-emitting component that has the highest intensity can be reflected.

If the structure of the invention is implemented using substantially rectangular light-reflecting surfaces, then these can produce preferably a substantially rectangular light pattern. The reflecting surfaces may be substantially the same size, but as regards the light pattern to be produced, it may be preferable that they are substantially of the same shape but of different sizes depending on how they are positioned in relation to the emitting surface. Such a structure is preferable for use e.g. in a dental operation light, but the light pattern may naturally also have some other shape.

The dental operation light of the invention thus comprises at least one light-emitting component and one or more substantially planar reflecting surfaces for each emitting component. The reflecting surface is preferably substantially planar. The light preferably has for each at least one light-emitting component at least two, preferably a large number of reflecting surfaces, allowing each reflecting surface to be so arranged in respect of its dimensions and positioning that each surface in itself produces from the emitting light source a desired light pattern at a given distance from the illuminator. The size of each light-reflecting surface and the distance between them can be so arranged that the intensity of the light falls sharply in the area of the penumbral shadow produced. From a plurality of equally or differently sized light-reflecting surfaces, it is possible to form a continuous structure in which each surface is so oriented that the light patterns produced by them fall one over the other. On the other hand, the shape of each of the light patterns separately may be freely defined. The light can also be so implemented that it consists of a plurality of light sources producing light patterns that can be arranged to fall one over the other. Thus, the light may comprise at least two units comprising a light-emitting component (9) so that the light pattern produced by each unit is directed at substantially the same place on the area to be illuminated. In this case, the light-emitting components (9) may be mounted on a supporting structure common to them both in such manner that the light-reflecting surfaces of the light-emitting components (9) are arranged to be at an angle relative to each other and to point away from said supporting structure.

The invention claimed is:

1. A dental operation light, comprising an at least one light-emitting component (9) having a light-emitting surface and an at least one light-reflecting surface (Mn), wherein the light-emitting surface of the at least one light-emitting component (9) is so arranged in the operation light that all or substantially all of the light produced by the operation light consists of light reflected from the at least one light-reflecting surface (Mn), and for each light-emitting component (9) at least one light-reflecting surface (Mn) is provided so that, regarding each light emitting component (9), the dimensions of the light-emitting surface in relation to the size of the at least one light-reflecting surface (Mn) arranged for the light-emitting component (9) in question, the direction of the normal to the light-emitting surface in relation to the direction of the normal to the at least one light-reflecting surface (Mn) arranged for the light-emitting component (9) in question, and the distance of the light-emitting surface to the at least one reflecting surface (Mn) arranged for the light-emitting component (9) in question in relation to the distance of the light-reflecting surface (Mn) to a light pattern forming surface (11)

have been so arranged that the dental operation light produces, on the light pattern forming surface (11), a light pattern of a given shape and size wherein the light intensity in the penumbral shadow area formed at the edges of the light pattern falls in a desired manner.

2. The dental operation light according to claim 1, wherein the light-emitting surface of the at least one light-emitting component (9) has been arranged in relation to the at least one light-reflecting surface (Mn) in such manner that the ratio of the distance between the light emitting surface and the at least one light-reflecting surface (Mn)

to at least one dimension of the light-emitting surface is in the range of 5-300 in the plane of the dimension in question.

3. The dental operation light according to claim 1, wherein the dental operation light comprises at least two light reflecting surfaces (Mn) for each of the at least one light-emitting component (9), the at least two light-reflecting surfaces (Mn) being arranged in such manner that, when the light pattern forming surface (11) at a distance in the range of 0.2-5 m from the at least one light-emitting component (9), the sum of a distance (c) and a distance (d) for each the aforesaid at least two light-reflecting surfaces (Mn) is substantially the same, wherein (c) is the distance from a light-reflecting surface (Mn) to a light-emitting surface, and (d) is the distance from a light-reflecting surface (Mn) to the aforesaid light pattern forming surface (11).

4. The dental operation light according to claim 3, wherein the range is of the order of below 1 m from the light-emitting component (9).

5. The dental operation light according to claim 1, wherein the center of the light-emitting surface is arranged on the optical axis of the dental operation light.

6. The dental operation light according to claim 1, wherein the light-emitting surface is arranged at an angle to the optical axis of the dental operation light.

7. The dental operation light according to claim 1, wherein the dental operation light comprises at least two light reflecting surfaces (Mn), wherein the at least one light-emitting component (9) and the at least two light-reflecting surfaces (Mn) are so positioned relative to each other that the at least two light-reflecting surfaces (Mn), substantially the centers of the at least two light-reflecting surfaces (Mn), form a structure (10) substantially resembling the shape of an elliptic arc, and the at least one light-emitting component (9) is arranged substantially at that focus of the ellipse in question which is closer to that part of the elliptic arc where the aforesaid at least two light-reflecting surfaces (Mn) are located.

8. The dental operation light according to claim 1, wherein the dental operation light comprises at least two of the light-reflecting surfaces (Mn) such that each of the at least two light-reflecting surfaces (Mn) are substantially of the same shape, whereby said given shape of the light pattern produced by the dental operation light is arranged to substantially correspond to the shape of said at least two light-reflecting surfaces (Mn) of substantially the same shape and of the same size or different sizes.

9. The dental operation light according to claim 1, wherein for each at least one light-emitting component (9) a large number of light-reflecting surfaces (Mn) are provided.

10. The dental operation light according to claim 1, wherein the light-emitting surface, the light emitting surfaces or a substantial proportion of them are substantially rectangular in shape.

11. The dental operation light according to claim 1, wherein for each at least one light-emitting component (9) a large number of light-reflecting surfaces (Mn) of the same shape and of equal or different dimensions are provided.

12. The dental operation light according to claim 1, wherein the distance between the aforesaid light-emitting surface of the light-emitting component (9) and the aforesaid at least one light-reflecting surface (Mn) is of the order of below 35 mm, the aforesaid at least one light-reflecting surface (Mn) has a length and/or a width and/or a diameter of below 10 mm, and wherein a plurality of light-reflecting surfaces (Mn), are provided for each at least one light-emitting component (9).

13. The dental operation light according to claim 12, wherein said length and/or width and/or diameter is about 2-6 mm.

14. The dental operation light according to claim 1, wherein the dental operation light comprises two unit, each unit comprising at least one light-emitting component (9) in such manner that a light pattern produced by each unit is directed at substantially the same place on the light pattern forming surface (11).

15. The dental operation light according to claim 14, wherein the light-emitting components (9) are mounted on a supporting structure common to them both in such manner that the light-emitting surfaces of the light-emitting components (9) are arranged to be at an angle relative to each other and to point away from said supporting structure.

16. The dental operation light according to claim 1, wherein the aforesaid at least one light-reflecting surface (Mn) is substantially planar.

17. A dental operation light, comprising at least one light-emitting component (9) and at least one substantially planar light reflecting surface (Mn) for said at least one light emitting component (9), wherein, for at least one of said light-emitting components (9), a number of light-reflecting surfaces (Mn) has been arranged such that said light-reflecting surfaces (Mn) are so arranged in respect of their dimensions and positions that each such surface produces the same desired light pattern at a given distance and location from the operation light.

18. The dental operation light according to claim 17, wherein said number of light-reflecting surface (Mn) are arranged to form a continuous structure in which each of the light-reflecting surface (Mn) is so oriented that the light patterns produced by each fall one over the other.

19. The dental operation light according to claim 17, wherein said number of light-reflecting surfaces (Mn) are rectangular and substantially of the same size, the differences in sizes, if any, depending on how said surfaces are positioned in the operation light in relation to the light-emitting surface so as each of the light-reflecting surfaces (Mn) produces a rectangular light pattern of the same size at a given distance from the dental operation light.

20. The dental operation light according to claim 17, wherein the dental operation light comprises at least two light-emitting components (9), which are mounted on a support structure common to them both in such manner that the light-emitting surfaces of the light emitting components (9) are oriented at an angle relative to each other and point away from said support structure.

* * * * *